United States Patent [19]

Crandall

[11] 4,275,117

[45] Jun. 23, 1981

[54] STRING CONSTRUCTION PRODUCED BY SUBJECTING A FIBROUS STRAND COMPOSED OF FIBROUS MATERIALS HAVING DIFFERING MELTING POINTS TO HEATING CONDITIONS SUFFICIENT TO MELT SOME BUT NOT ALL OF THE FIBROUS MATERIALS

[75] Inventor: Steven J. Crandall, Quonochontaug, R.I.

[73] Assignee: Ashaway Line & Twine Mfg. Co., Ashaway, R.I.

[21] Appl. No.: 909,212

[22] Filed: May 22, 1978

Related U.S. Application Data

[63] Continuation-in-part of Ser. No. 830,349, Sep. 2, 1977, abandoned.

[51] Int. Cl.[3] ..... B32B 27/02; D02G 3/04; D02G 3/36; D02G 3/40

[52] U.S. Cl. ..... 428/373; 57/6; 57/13; 57/15; 57/210; 57/224; 57/230; 57/234; 57/250; 57/251; 57/258; 57/297; 156/148; 156/180; 156/221; 156/296; 264/331.19; 264/DIG. 26; 428/374; 428/394; 428/395; 428/396; 264/331.17

[58] Field of Search ..... 57/6, 13, 15, 250, 251, 57/258, 297, 210, 234; 156/148, 180, 221, 290; 264/331, DIG. 26; 428/394, 395, 396, 373, 374

[56] References Cited

U.S. PATENT DOCUMENTS

| | | | |
|---|---|---|---|
| 3,508,990 | 4/1970 | Maryocchi | 156/166 |
| 3,645,819 | 2/1972 | Fujii et al. | 156/166 |
| 3,716,614 | 2/1973 | Okamoto et al. | 156/155 |
| 3,862,287 | 1/1975 | Davis | 156/180 |
| 4,055,941 | 11/1977 | Rivers | 428/397 |

*Primary Examiner*—James C. Cannon
*Attorney, Agent, or Firm*—Salter & Michaelson

[57] ABSTRACT

An integrated string primarily for use in connection with athletic rackets, such as tennis, badminton, squash and the like, but also usable for fishing line, musical strings, etc., said string in one embodiment comprising a thermoplastic core having a thermoplastic sheath covering same and integrated thereto, said core material and said sheath comprising strands therein having substantially different melting points, and in a second embodiment said string consisting of a braided sheath, with no inner core, said sheath comprising thermoplastic strands having substantially different melting points.

28 Claims, 14 Drawing Figures

STRING CONSTRUCTION PRODUCED BY SUBJECTING A FIBROUS STRAND COMPOSED OF FIBROUS MATERIALS HAVING DIFFERING MELTING POINTS TO HEATING CONDITIONS SUFFICIENT TO MELT SOME BUT NOT ALL OF THE FIBROUS MATERIALS

BACKGROUND AND SUMMARY OF THE INVENTION

This application is a continuation-in-part of U.S. application Ser. No. 830,349, filed Sept. 2, 1977, now abandoned. In addition to the patents cited in said application Ser. No. 830,349, U.S. Pat. Nos. 3,508,990 (Marzocchi) and 3,862,287 (Davis) are representative of the prior art.

It has long been known that highly durable and effective string for tennis rackets and the like may be formed by providing a core, usually of a thermoplastic material, and then integrating a spiral wrap or braid usually being formed from a thermoplastic filament, so as to impart the desired strength and flexibility characteristics to the integrated string. Various types of strings utilizing this basic concept are illustrated and described in assignee's prior U.S. Pat. Nos. 2,649,833 dated Aug. 24, 1953; 2,712,263 dated July 5, 1955; 2,735,258 dated Feb. 21, 1956; 2,861,417 dated Nov. 25, 1958; 3,738,096 dated June 12, 1973; and 3,745,756 dated July 17, 1973; and 4,016,714 dated Apr. 12, 1977.

In all of the above-mentioned patents, the procedure for effecting integration, whether it be integration of a multi-filament core, or whether it be integration of a spiral wrap or braided cover to the core, has been to pass the components to be integrated through a liquid nylon formulation, and then passing the coated string at a predetermined rate of speed through an elongated drying tower that is maintained at a predetermined temperature to effect curing of the nylon solution, drive off the solvents therefrom, etc. In order to effect proper integration, the coating of the component to be integrated with the nylon formulation and the subsequent trips through the drying tower must normally be repeated a substantial number of times, and in those strings where the integration process takes place a number of times, i.e., strings where the core has to be first integrated and then a plurality of wraps and/or braids are applied thereover, it will be seen that the number of dips and trips through the drying tower are accordingly multiplied.

Although the strings in which the integration steps are formed by dipping in a nylon formulation and then passing the dipped string through a heating tower have proven to be quite feasible and satisfactory, it will be obvious that the necessity of having to repeatedly dip and dry is time consuming, thus creating added costs in the manufacture of the string, as well as obvious limitations on quantity production thereof. Furthermore, the rather substantial dimensional length of the necessary heating tower requires that adequate manufacturing space be available for the location of this apparatus. In addition, it is sometimes found that when the solvents in the nylon formulation are being driven off by the application of heat thereto, an undesirable migration of the plastic itself takes place, which sometimes adversely affects the desired uniformity of integration that takes place.

The present invention, while in some embodiments directed to strings which form an end product stand point are basically the same as those disclosed in the abovementioned patents, utilizes a completely new and different technique for effecting the desired integration of the string components. More specifically, in the present invention, more effective integration is achieved without utilizing the aforesaid nylon dip and the subsequent trips through the drying tower. This is accomplished by utilizing relatively high melt and low melt thermoplastic materials as the string components, and then effecting integration by applying heat thereto sufficient to melt the low melt material, but not sufficient to melt the high melt material. Thus, the core of the string might be formed in whole or in part of a high melt material, and then a sheath of low melt material may be applied thereover, such as by braiding, after which sufficient heat is applied to the core and sheath so as to melt the latter but not the former, the melting of the sheath resulting in an effective integration or bonding of the sheath to the core. The heat may be applied by any suitable means, such as by passing the string through a heated die which may or may not physically engage the outer surface of the string. In many cases, in order to impart the desired strength to the string, it may be desirable to apply a spiral wrap of high melt material around the core of the string. In such an arrangement, a braid of low melt material is applied over the core and is heat integrated thereto and then the spiral wrap of high melt material is applied around the integrated core and low melt braid, after which heat sufficient to melt the low melt material but not sufficient to melt the high melt material is applied, wherein the melting of the low melt material effects the desired bonding and integration of the composite string. Thus, it will be seen that the application of the low melt braid and the subsequent application of the proper heat functions as a complete substitute for the nylon dip and trips through the drying tower heretofore necessary to effect the desired integration and bonding of strings of this type. It has been found where integration has been effected by means of the present invention, increase in production of the finished string at lower costs is possible. In addition, the integration and bonding effected by the present invention is actually superior in many cases to the integration and bonding that takes place by dipping and drying.

It has also been found that a satisfactory string can be achieved by utilizing a core consisting entirely of low melt strands with a sheath thereover (braid or spiral wrap) of high melt strands or in some cases, a braided sheath comprising a combination of high and low melt strands. Also, with smaller diameter strings, it has been found that the core can be entirely eliminated, in which event the basic component of such a string would simply be a braid comprising a predetermined combination of high and low melt strands integrated by the application of heat sufficient to melt the low melt strands but not the high melt ones. In fact, the basic and salient concept of this invention, in all its forms and embodiments, is the combining of high and low melt thermoplastic strands whereby integration of the string is achieved by the application of heat sufficient to melt the low melt strands but not the high melt ones.

It is therefore a primary object of this invention to provide an integrated string comprising thermoplastic components wherein said components are more effectively and efficiently integrated.

A further object is the provision of a string of the character described which may be more quickly, easily and less expensively manufactured.

Another object is the provision of a string of the character described wherein integration of the thermoplastic components is effected without the necessity of using any liquid dips or coatings, thereby also eliminating any subsequent drying or curing operations that would automatically be associated therewith.

Other objects, features and advantages of the invention shall become apparent as the description thereof proceeds when considered in connection with the accompanying illustrative drawing.

DESCRIPTION OF THE PREFERRED FORM OF THE INVENTION

Figure 1:
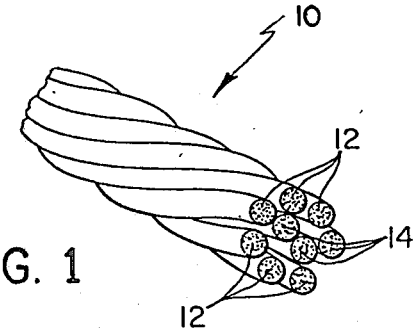
FIG. 1 is a fragmentary perspective view showing a multi-filament core that may be utilized in making the string of the instant invention.

Referring to the drawing, and more particularly to FIG. 1, there is shown a core 10 comprising a plurality of gently twisted filamentous thermoplastic strands. In the core specifically illustrated in FIG. 1, a total of nine separate ends are shown, although it will be understood that more or less could be effectively utilized. Preferably, the majority of the individual ends comprise a high melt thermoplastic material, such as a material commonly known in the trade as 840 denier Nylon 66, having a melting point of approximately 480° F. In the illustrated embodiment, six of the nine ends are Nylon 66 and these are shown at 12. The other three ends or strands are shown at 14 and these preferably comprise a low melt theremoplastic material, such as material commonly known in the trade as K 155, which is a nylon based ter-polymer having a melting point of approximately 310° F. Other low melt materials which could be used are Nylon 12, which is a nylon polymer having a melting point of approximately 350° F. or K 115, another nylon based terpolymer which melts at approximately 230° F. It has specifically been found that K 155 and K 115 bond or integrate extremely well with Nylon 66, but are not as rugged as Nylon 12, which exhibits better abrasion resistance and better resistance to moisture absorption. In some cases, where the string is constructed according to the present invention utilizing only K 155 or K 115 as the low melt material, the final string may not possess sufficient stiffness characteristics, i.e. may be too limp. Conversely, in some strings where Nylon 12 is used exclusively as the low melt material, the final string may be too stiff. Accordingly, where a plurality of layers or sheaths of low melt material are utilized at different stages in the manufacture of a single string, it may be desirable to use K 155 or K 115 for some of the sheaths and Nylon 12 for the others, particularly the outermost layer where abrasion resistance and resistance to moisture absorption would be most important.

Other polymers that melt without degradation at a temperature less than Nylon 66 and which therefore may be used as the low melt material are Surlyn (trademark of DuPont) and polypropylene.

Figure 2:
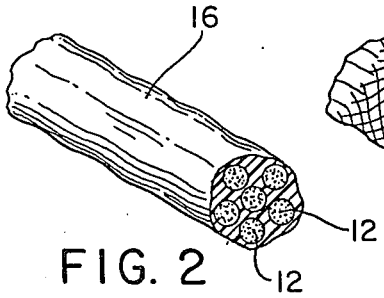
FIG. 2 shows the core of FIG. 1 after a predetermined degree of heat has been applied thereto.
Figure 3:
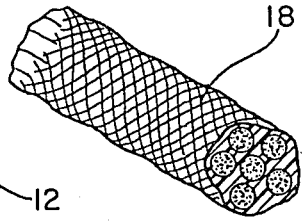
FIG. 3 shows the core of FIG. 2 with a low melt theremoplastic filament braided thereover.
Figure 4:
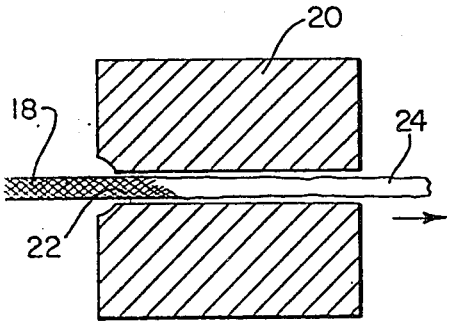
FIG. 4 shows the string of FIG. 3 passing through a heated die, the latter being shown partly in section.

As previously stated, the core 10 illustrated in FIG. 1 preferably comprises six ends of Nylon 66 gently twisted together with three ends of K 155, all of approximately 840 denier, after which the core is subjected to heat sufficient to melt the K 155 but not sufficient to melt the Nylon 66. It has been found that a temperature of approximately 325° F. is sufficient to accomplish this, whereupon the melting of the K 155 strands integrates the core, as illustrated in FIG. 2, it being understood that the strands 12 are still discrete and unmelted. Thus, it will be seen that by combining the high melt and low melt strands as part of the core, and then heating the core to a temperature sufficient to melt the low melt strands but not the high melt strands, a convenient and expeditious technique is provided for forming the integrated core 16. It should be understood, however, that the core could be integrated in other ways, such as, for example, by utilizing only Nylon 66 strands and then passing the twisted Nylon 66 strands through the nylon formulation disclosed in our aforementioned patents, and then through the drying tower. In any event, once the core has been integrated, the next step is to apply a braided sheath 18 thereover, as by using any suitable braiding equipment, the braid 18 being constructed of a low melt thermoplastic material, such as K 155. Actually, the sheath 18 could be a spiral wrap, as well as a braid, although it has been found that utilizing a braid for the low melt material subsequently results in better bonding and integration of the string. In any event, after the sheath 18 of low melt material has been applied to the core 16, the braided core is subjected to heat, as by passing it through a heated die shown at 20. The entrance and exit die orifices, 22, 24, respectively, are just slightly larger than the diameter of the braided core, whereupon no wiping action is imparted to the string as it passes therethrough. It will be understood, however, that the die 20 imparts sufficient heat to melt the braid 18 but not sufficient to melt the Nylon 66 in the core and once again, it has been found that a temperature of approximately 325° F. is quite satisfactory. It will be understood that when the string of FIG. 4 exits from the die 20, the braid 18 will have melted and will have integrated with and bonded to the core 16. At this point, in order to impart additional strength to the string, a spiral wrap 26 of Nylon 66 is applied thereto, as illustrated in FIG. 5, and then the string with the spiral wrapping thereover is again passed through a heated die maintained at approximately 325° F. whereupon the melting of the low melt material in the string bonds and integrates the wrap 26, although no melting of the latter takes place.

Figure 5:
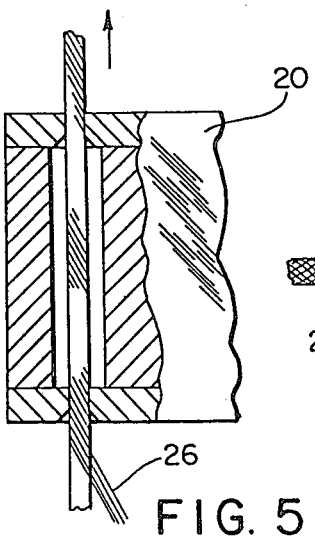
FIG. 5 shows the resultant string of FIG. 4 having a high melt spiral wrap applied thereto and then being passed through a heated die.
Figure 6:
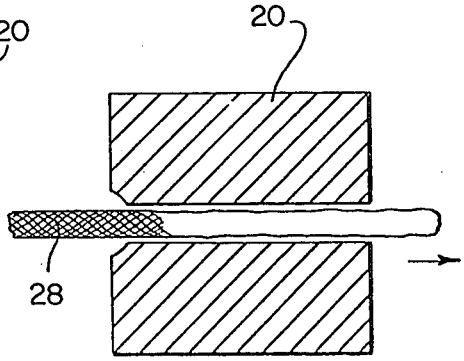
FIG. 6 shows the resultant string of FIG. 5 having a further low melt braid applied thereover and then being passed through a heated die.

After the string of FIG. 5 has exited from the die 20, another sheath 28, preferably a braid, is applied thereover, the braid again preferably being K 155, and then the braided string is again passed through the die 20, the latter being once again maintained at a temperature of approximately 325° F., whereupon once again the melting of the braid 28 and the other low melt materials in the string results in effective bonding and integration thereof. A further spiral wrap 30 of Nylon 66 of opposite hand to the wrap shown in FIG. 5 may be applied to the string which exits from the die shown in FIG. 6, with the wrapped string again passing through the heated die 20, maintained at approximately 325° F., to bond and integrate the wrap 30 to the string. A final braid 32 of low melt material is then applied to the string, and since this in effect forms the outer coating of the string, it is preferable to use Nylon 12 at this point. The string with the braid 32 thereon is then passed through the die 20, which is now maintained at approximately 380° F. , sufficient to melt the Nylon 12, but not the Nylon 66 present in the string. The integrated string 34 which exits from the die of FIG. 8 is then the final string. It will be understood that since the addition of each sheath and subsequent wrap creates a continuing build-up of the string, the entrance and exit orifices in the dies shown in FIGS. 4–8 are progressively increased in size. As previously stated, the purpose of the die 20 is to provide a convenient means for applying the desired degree of heat to the string so as to effect bonding and integration thereof, and hence it is not necessary that the exit orifices of the die impart a wiping action to the string, although in some cases it may be desirable to have the exit orifice of the die just slightly smaller than the diameter of the approaching string whereby a wiping action will be imparted to the string.

Figure 7:
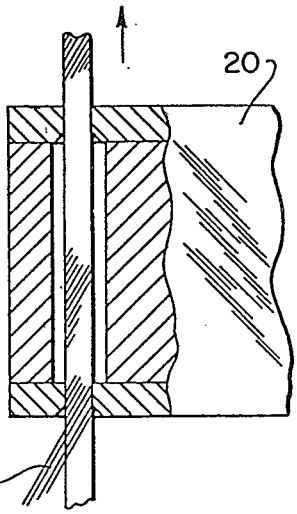
FIG. 7 shows the resultant string of FIG. 6 having a further high melt spiral wrap applied thereto and then being passed through a heated die.
Figure 8:
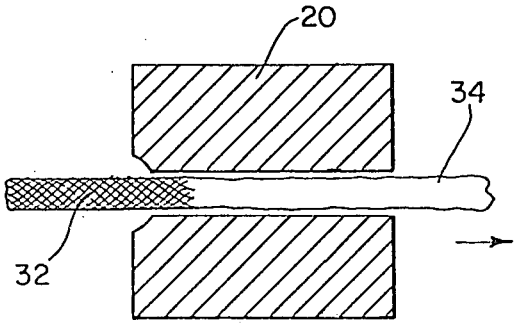
FIG. 8 shows the resultant string of FIG. 7 having a further low melt braid applied thereover and then being passed through a heated die.
Figure 9:
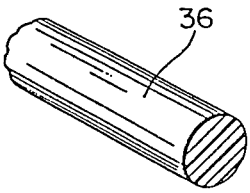
FIG. 9 is a fragmentary perspective view showing a monofilament core that may be used in connection with the present invention.
Figure 10:
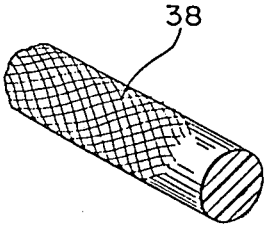
FIG. 10 shows the monofilament core of FIG. 9 having a low melt braid applied thereover.

Instead of using the multi-filament core shown in FIG. 1, it is possible to make the same string illustrated in FIGS. 1–8 utilizing a monofilament core, such as the core 36 shown in FIG. 9. Where the core is of a monofilament, the material would be high melt material, such as Nylon 66 and then a sheath of low melt material, as shown in FIG. 10 at 38, would be applied thereover after which the steps of FIGS. 4–8 would then be again repeated. While the use of monofilament core permits satisfactory string to be produced, such a string will frequently exhibit less flexibility and resilience than a string having a multi-filament core.

It should be understood that the steps illustrated in FIGS. 1–10 are purely by way of example since any number of wraps of the Nylon 66, as illustrated in FIGS. 5 and 7, may be utilized, depending on the ultimate characteristics required for the string, or in some extreme cases, no such wraps may be employed. Also, instead of spirally wrapping the Nylon 66, as illustrated in FIGS. 5 and 7, Nylon 66 could be applied in the form of a braid. Likewise, as previously indicated, the application of the low melt layers or sheaths need not necessarily be in the form of a braid, as illustrated in the drawings, but rather could be in the form of a spiral wrap, although in practice the use of a braid has been found to be preferable. It would be possible, however, to apply the low melt layers or sheaths by utilizing a slitted film of low melt material, which would then be spirally wrapped around the string. The important thing is that the application of the low melt sheath or layer and then the subsequent application of heat sufficient to melt the low melt material but not sufficient to melt the high melt material in the string results in extremely efficient bonding and integration of the string. As previously stated, K 155, K 115 and Nylon 12 bond extremely well to Nylon 66, and hence where the latter is used as the high melt material, an extremely well-integrated string results, although it should be understood that the basic concept of the present invention is directed to the aforesaid combination of high and low melt materials, and not to any specific material per se.

In some cases it is possible to utilize a multifilament core of high melt filaments exclusively, and then apply the low melt braid directly thereover. The problem with such an arrangement is that the braid, when melted, might not reach the center of the core to integrate same, whereupon the final string might be softer and more flexible than desired, although possibly usable as a less expensive string.

Figure 11:
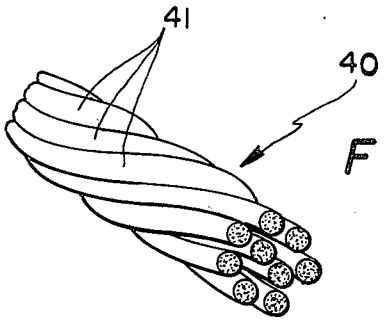
FIG. 11 is a fragmentary perspective view showing a multi-filament core consisting entirely of low melt filaments.
Figure 12:
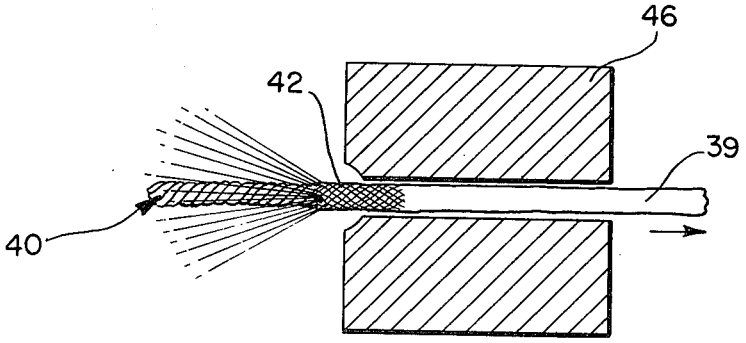
FIG. 12 shows the core of FIG. 11 with a braided sheath applied thereover and then integrated by being passed through a heated die.
Figure 13:
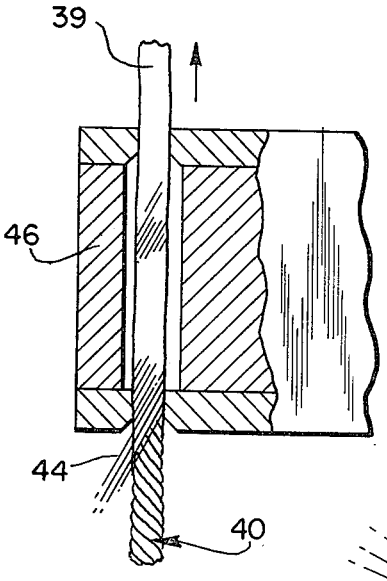
FIG. 13 shows the core of FIG. 11 with a spiral wrap applied thereover and then integrated by being passed through a heated die.

Conversely, it has been found that it is possible to construct a string 39 utilizing a core 40 made up entirely of low melt filaments 41 (see FIG. 11) which is then covered with a braided sheath 42 (FIG. 12) or a spiral wrap 44 (FIG. 13) of high melt material, and then passed through a heated die 46 maintained at a temperature sufficient to melt the core 40 but not the sheath 42 of wrap 44, whereupon the melting of core 40 results in bonding of the core to the sheath and integration of the string to some degree. It will be understood that the core 40 can comprise any of the low melt materials hereinbefore mentioned, such as K 115, K 155 or Nylon 12 while the sheath or wrap could be of Nylon 66.

Figure 14:
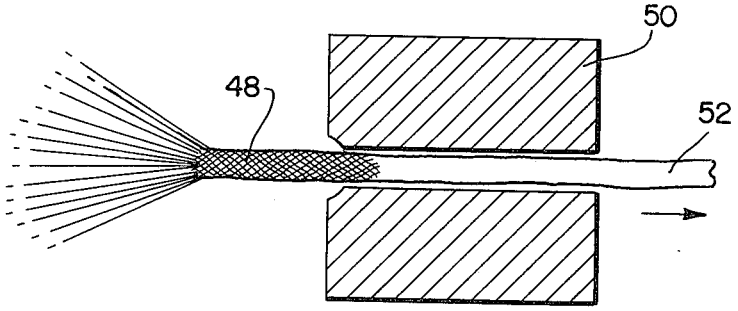
FIG. 14 illustrates a modified form of my invention wherein the string is formed from a braided sheath of high and low melt filaments without utilizing any core.

It some cases it has been found that a highly uniformly integrated string can be achieved by using the low melt core 40 and then applying a braided sheath thereover wherein said braid comprises a combination of high and low melt strands. Once again the braided string is heated, such as by being passed through a heated die, to a temperature sufficient to melt the low melt strands but not the high melt ones to effect the desired integration of the string. This type of string has been found to be more satisfactory for strings having a diameter larger than approximately 0.035" (tennis strings normally will be in the range of 0.045"–0.060" diameter) but where a string having a diameter of less than 0.035" is required, such as a badminton string, then it has been found that the core may be eliminated entirely and the string made up solely of a braided sheath 48 (FIG. 14) comprising a combination of high and low melt strands, which sheath is then passed through the heated die 50 so as to melt the low melt strands but not the high melt ones, whereby a core-less integrated string 52 is provided. In such a string, because of its small diameter, the melted low melt material in the braid flows inwardly to a sufficient extent to result in a solid string, i.e., one with no appreciable voids in its center. In order to properly integrate and coat the finished string 52, the low melt material should preferably comprise at least approximately 25% of the weight of the finished string. This can be accomplished by utilizing a standard braid, such as that produced by a 16 carrier braiding machine with high and low melt material on alternate carriers, and by selecting the proper denier nylon for the high melt material, such as Nylon 66 of 1050 denier, which when braided with K 155 of 840 denier and then passed through a heated die of 0.032 diameter will result in a finished integrated string having the necessary properties to function as an effective badminton string. In other words, by braiding high and low melt materials of selected deniers so that the low melt comprises at least approximately 25% of the weight of the finished string, and then integrating by the application of heat sufficient to melt the low melt material only, the necessity of utilizing the traditional high strength core is eliminated, although as aforesaid, if the diameter of the string is to be over 0.035", then a low melt core should be used to insure a substantially solid, void-free string.

It is once again emphasized that the basic and salient concept of the present invention is the combination of compatible low melt and high melt materials, whereupon effective bonding and integration is achieved, as aforedescribed, by the application of heat sufficient to melt the low melt material but not sufficient to melt the high melt material. Thus, the use of the low melt material and the subsequent heating thereof actually functions as a substitute for the nylon dip described in our previous patents, and the subsequent trips through the drying tower to effect curing thereof. Thus, the present invention is actually applicable to any of the strings disclosed and described in our previous patents, simply by replacing the nylon dip and subsequent drying operation with the application of the low melt sheath and subsequent heating thereof. It is obviously possible to continue to use the nylon dip to effect bonding in some stages of the manufacture of the string, illustrated in FIGS. 1–10, and to utilize the present invention to effect bonding at other stages thereof, if such should be desirable for any reason, or in the alternative, the nylon dip can be completely eliminated, as exemplified by the string illustrated in the drawings of the present case. In any event, as heretofore explained, the bonding and integration utilizing the techniques of the present invention have proven to be highly effective, while at the same time permitting increased production at lower costs and with lesser space consuming equipment required. Also, the provision of a string comprising a combined high and low melt braid subsequently integrated by the application of heat is thought to constitute a novel, unique and important feature of the present invention whether the braid per se makes up the entire string, as in FIG. 14, or whether used in combination with a low melt core, as in FIG. 12. By the same token, the use of a low melt core (whether low melt multifilaments or monofilament) is thought to constitute a novel step forward in the art, both where the low melt core is covered by a high melt sheath (braid or spiral) and where it is covered by a combined high and low melt braid. Actually, it will be understood that a braid of combined high and low melt strands could be utilized in place of the low melt braids 18, 28 and 32 of FIGS. 1–8 since the low melt strands in such a combined braid would in many cases provide sufficient integration for the string.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An integrated string construction resulting from the integration under heating conditions of a combination of elongated strands of first and second thermoplastic material, said first thermoplastic material having a substantially higher melting point than said second thermoplastic material, said string having been integrated by the application of heat sufficient to melt said second material, but not said first material, said string, prior to integration, having compressed a core consisting at least in part of said second material, and a braided sheath over said core comprising strands of both said first and second materials.

2. The string of claim 1 further characterized in that prior to integration said core consisted solely of said second material.

3. An integrated string construction resulting from the integration under heating conditions of a combination of elongated strands of first and second thermoplastic material, said first thermoplastic material having a substantially higher melting point than said second thermoplastic material, said string having been integrated by the application of heat sufficient to melt said second material, but not said first material, said string, prior to integration, having comprised a core consisting solely of said first material, and a braided sheath over said core comprising strands of both said first and second materials.

4. An integrated string construction resulting from the integration under heating conditions of a combination of elongated strands of first and second thermoplastic material, said first thermoplastic material having a substantially higher melting point than said second thermoplastic material, said string having been integrated by the application of heat sufficient to melt said second material, but not said first material, said string, prior to integration, having consisted solely of a braid comprising strands of both said first and second materials.

5. The string of claim 4 further characterized in that said second material comprises at least approximately 25% by weight of the finished string.

6. An integrated string construction resulting from the integration under heating conditions of a combination of elongated strands of first and second thermoplastic material, said first thermoplastic material having a substantially higher melting point than said second thermoplastic material, said string having been integrated by the application of heat sufficient to melt said second material, but not said first material, said string, prior to integration, having comprised a core consisting entirely of said second material, and a sheath consisting entirely of said first material surrounding said core.

7. An integrated string construction resulting from the integration under heating conditions of a combination of elongated strands of first and second thermoplastic material, said first thermoplastic material having a substantially higher melting point than said second thermoplastic material, said string having been integrated by the application of heat sufficient to melt said second material, but not said first material, said string, prior to integration, having comprised a core consisting of a plurality of filamentous strands of said first material twisted together with one or more filamentous strands of said second material, and a sheath comprising at least in part said second thermoplastic material surrounding said core.

8. In an integrated string construction, a core comprising at least in part a first thermoplastic material, a sheath comprising at least in part a second thermoplastic material enveloping said core, said first thermoplastic material having a substantially higher melting point than said second thermoplastic material, said sheath having been bonded to said core by the application of heat sufficient to melt the said second material but not said first material, said sheath, prior to integration, having consisted of a braided cover.

9. In an integrated string construction, a core comprising at least in part a first thermoplastic material, a sheath comprising at least in part a second thermoplastic material enveloping said core, said first thermoplastic material having a substantially higher melting point than said second thermoplastic material, said sheath having been bonded to said core by the application of heat sufficient to melt the said second material but not said first material, said sheath, prior to integration, having consisted of a spirally wound cover.

10. In an integrated string construction, a core comprising at least in part a first thermoplastic material, a sheath comprising at least in part a second thermoplastic material enveloping said core, said first thermoplastic material having a substantially higher melting point than said second thermoplastic material, said sheath having been bonded to said core by the application of heat sufficient to melt the said second material but not said first material said string further comprising a cover (I) of said first material over said sheath, and a cover (II) of said second material thereover, said covers (I) and (II) having been bonded by the application of heat sufficient to melt said second material but not said first material.

11. The string of claim 9 further characterized in that prior to integration said cover (I) was a spiral wrap and said cover (II) was a braid.

12. The string of claim 10 further comprising a cover (III) thereover of said first material and a cover (IV) thereover of said second material, said cover (III), prior to integration, having comprised a spiral wrap of opposite hand to said second cover, and said cover (IV), prior to integration, having comprised a braid, said covers (III) and (IV) having been integrated by the application of heat sufficient to melt said second material but not said first material.

13. The method of making an integrated racket string comprising the steps of forming an elongated braided sheath from strands of first and second thermoplastic material; said first material having a melting point substantially higher than that of said second material and then applying heat thereto sufficient to melt said second material but not said first material.

14. The method of claim 13 further characterized in that said application of heat is achieved by passing said string through a heated die.

15. The method of claim 13 further characterized in that said braided sheath is applied over an elongated thermoplastic core.

16. The method of claim 15 further characterized in that said core is constructed at least in part of said second material.

17. The method of claim 15 further characterized in that said core is constructed entirely of said second material.

18. The method of claim 15 further characterized in that said core is constructed entirely of said first material.

19. The method of claim 13, further characterized in that said second material comprises at least approximately 25% by weight of said integrated string.

20. The method of making an integrated tennis string comprising the following steps:

(a) forming a core by twisting together a plurality of filamentous strands of a first thermoplastic material with a plurality of filamentous strands of a second thermoplastic material characterized in that said first material has a substantially higher melting point than said second material;

(b) integrating said strands by the application of heat sufficient to melt said second material, but not said first material;

(c) applying a sheath comprising at least in part said second thermoplastic material over said core;

(d) applying sufficient heat to said string to melt said second material, but not said first material.

21. The method of claim 20 comprising the following additional steps:

(e) applying a second cover of said first material over said sheath;

(f) applying sufficient heat to the resultant string to melt said second material, but not said first material;

(g) applying a third cover of said second material over said resultant string; and (h) applying sufficient heat to the resultant string to melt said second material, but not said first material.

22. The method of claim 21 comprising the following additional steps:

(h) applying a fourth cover of said first material over said string;

(i) applying sufficient heat to the resultant string to melt said second material, but not said first material;

(j) applying a fifth cover of said second material over said string; and (k) applying sufficient heat to the resultant string to melt said second material, but not said first material.

23. The method of claim 22 further characterized in that Steps D and H comprise spiral wraps in opposite hand, while Steps F and J comprise braiding of said covers.

24. The method of making an integrated string comprising the following steps:

(a) forming a core of a first thermoplastic material;

(b) applying a sheath comprising at least in part a second thermoplastic material over said core characterized in that said first material has a substantially higher melting point than said second material;

(c) integrating said sheath and core by applying heat to said string sufficient to melt said second material, but not said first material.

25. The method of claim 24 further characterized in that step (a) comprises twisting together a plurality of said first thermoplastic material.

26. The method of claim 24 further characterized in that step (b) comprises braiding said sheath over said core.

27. The method of claim 24 further characterized in that step (b) comprises spirally wrapping said sheath over said core.

28. The methods of claim 27 wherein said spiral wrap comprises strands of both said first and second materials.

* * * * *